US006030465A

United States Patent [19]

Marcussen et al.

[11] Patent Number: 6,030,465

[45] Date of Patent: Feb. 29, 2000

[54] EXTRACTOR WITH TWIN, COUNTERROTATING AGITATORS

[75] Inventors: Henry Marcussen, Danville, Ky.; Toshiyuki Yoshida, Shiga, Japan

[73] Assignee: Matsushita Electric Corporation of America, Danville, Ky.

[21] Appl. No.: 09/202,849

[22] PCT Filed: Jun. 20, 1997

[86] PCT No.: PCT/US97/10632

§ 371 Date: Dec. 17, 1998

§ 102(e) Date: Dec. 17, 1998

[87] PCT Pub. No.: WO97/49324

PCT Pub. Date: Dec. 31, 1997

Related U.S. Application Data

[60] Provisional application No. 60/020,549, Jun. 26, 1996.

[51] Int. Cl.[7] ..... B08B 1/04; B08B 3/10; B08B 5/04; A47L 11/30

[52] U.S. Cl. ..... 134/6; 15/320; 15/384; 134/21

[58] Field of Search ..... 15/320, 384; 134/6, 134/21

[56] References Cited

U.S. PATENT DOCUMENTS

| | | | |
|---|---|---|---|
| 1,268,963 | 6/1918 | Gray | 15/384 X |
| 1,596,041 | 8/1926 | Young . | |
| 1,938,068 | 12/1933 | Deutscher . | |
| 2,622,254 | 12/1952 | Mendelson . | |
| 3,624,861 | 12/1971 | Freiheit . | |
| 3,631,558 | 1/1972 | Kovacevic | 15/384 X |
| 4,426,751 | 1/1984 | Nordeen . | |
| 5,018,240 | 5/1991 | Holman . | |
| 5,299,608 | 4/1994 | Bosyj . | |
| 5,406,673 | 4/1995 | Bradd et al. . | |
| 5,493,752 | 2/1996 | Crouser et al. . | |

FOREIGN PATENT DOCUMENTS 23 61894 A1 6/1975 Germany .

*Primary Examiner*—Chris K. Moore
*Attorney, Agent, or Firm*—King and Schickli

[57] ABSTRACT

An extractor is provided for cleaning carpet or a like surface or material. The extractor includes a housing, a handle, a cleaning liquid delivery system and a cleaning liquid recovery system. The cleaning liquid delivery system includes a cleaning liquid supply tank, first and second aligned agitators preferably in the form of brushes and a gravity feed or pump for delivering cleaning liquid from the supply tank for cleaning. The cleaning liquid recovery system includes a recovery nozzle, a vacuum generator and a dirty cleaning liquid recovery tank. The extractor is further characterized by a manifold for receiving cleaning liquid from the pump and directing the cleaning liquid into a nip defined between the first and second agitators. A drive assembly counterrotates the agitators so that relative rotation of the agitators in the nip is generally away from the manifold and toward the carpet to be cleaned. In accordance with the method of the present invention, cleaning liquid is delivered into the nip defined between the pair of counterrotating agitators. The cleaning liquid is thereby propelled by the counterrotating agitators through the nip deep into the carpet to be cleaned. This is followed by the recovering of the cleaning liquid.

5 Claims, 3 Drawing Sheets

12
26
28
46
12
38
36
42
42
32
48
50
54
28
36
38
12

EXTRACTOR WITH TWIN, COUNTERROTATING AGITATORS

This application claims of provisional application 60/020,549 filed Jun. 26, 1996 this application is a 371 of PCT/US97/10632 filed Jun. 20, 1997.

TECHNICAL FIELD

The present invention relates generally to the floor care field and, more particularly, to an upright extractor that utilizes a liquid to clean a carpet or like surfaces.

BACKGROUND OF THE INVENTION

Extractors that utilize a liquid to clean a carpet, upholstery or like surface are well known in the art. A typical state of the art extractor generally includes a cleaning liquid or diluted detergent delivery system comprising a container for holding the cleaning liquid, a stationary brush, a rotating agitator or a revolving scrubber for scrubbing the carpet or like surface to be cleaned; and a gravity feed or a pump for delivering the cleaning liquid to the surface to allow scrubbing and removal of the dirt. The typical state of the art extractor also includes a cleaning liquid recovery system comprising a recovery nozzle, a suction generating device, such as a motor driven fan and a dirty cleaning liquid recovery tank.

In order to provide the most effective and efficient cleaning action, it is imperative that the cleaning liquid is delivered deep into the carpet or other surface being cleaned so that deep, ground in dirt and soil may be removed by the extraction process. The present invention relates to a more efficient and effective mechanism for providing deep cleaning action and enhanced overall cleaning performance.

SUMMARY OF THE INVENTION

Accordingly, it is a primary object of the present invention to provide an extractor for the cleaning of carpets and like surfaces that is characterized by relatively simple and inexpensive construction and that provides reliable performance over a long service life.

Yet another object of the present invention is to provide an apparatus which furnishes more efficient and deep cleaning of soil and dirt from carpets and the like by means of a unique cleaning liquid delivery and agitator scrubbing system which functions to positively deliver cleaning liquid deep into the carpet being cleaned while also providing for scrubbing of the nap of the carpet in two opposed directions.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, an improved extractor is provided for cleaning carpet or other similar surface capable of being cleaned by liquid extraction. The extractor may be generally described as including a housing supported for movement relative to the carpet to be cleaned and a handle for manipulating and controlling the extractor. The extractor also includes cleaning liquid delivery and cleaning liquid recovery systems both carried by the housing.

The cleaning liquid delivery system includes a cleaning liquid supply tank, first and second aligned agitators and either a gravity feed or a pump for delivering cleaning liquid from the supply tank for cleaning. The cleaning liquid recovery system includes a recovery nozzle, a vacuum generator and a dirty cleaning liquid recovery tank.

The extractor is characterized by a drive assembly for counterrotating the first and second agitators so that relative rotation of the first and second agitators along the nip defined therebetween is generally away from the housing and toward the carpet to be cleaned. This counterrotating action functions to part the carpet nap open to the base and propel the cleaning fluid deep into the nap to enhance penetration and, therefore, the cleaning effect being produced.

In accordance with another aspect of the present invention, the extractor is characterized by the provision of a manifold for receiving cleaning liquid from either a gravity flow system or a pump and directing the cleaning liquid into the nip defined between the first and second agitators. Preferably, the manifold includes a longitudinal axis aligned with and parallel to the longitudinal axis of the first and second agitators as well as the nip defined therebetween. Additionally, the manifold includes a series of delivery ports provided in and spaced along the manifold opposite the nip. In this way, it is possible to deliver cleaning fluid in the appropriate quantity along the full transverse length of the nip so that cleaning fluid is distributed evenly and effectively deep into the carpet or like surface being cleaned.

In accordance with still another aspect of the present invention, the recovery nozzle of the extractor is aligned with and positioned adjacent to the first agitator. Further, it should be appreciated that the first agitator is being rotated in a direction toward the recovery nozzle. This aids in the extraction and recovery of the cleaning fluid which conveys and thereby extracts dirt and soil from the carpet being cleaned.

In accordance with the present invention, a method is also provided for cleaning carpet and like surfaces by liquid extraction. The method may be generally described as including the steps of delivering cleaning liquid into a nip defined between a pair of counterrotating agitators, propelling said cleaning liquid with said pair of counterrotating agitators through said nip deep into the carpet and recovering the cleaning liquid. This method insures deep cleaning action and provides the extractor of the present invention with a cleaning efficiency and effectiveness heretofore unavailable in the art.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of the specification, illustrates several aspects of the present invention and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
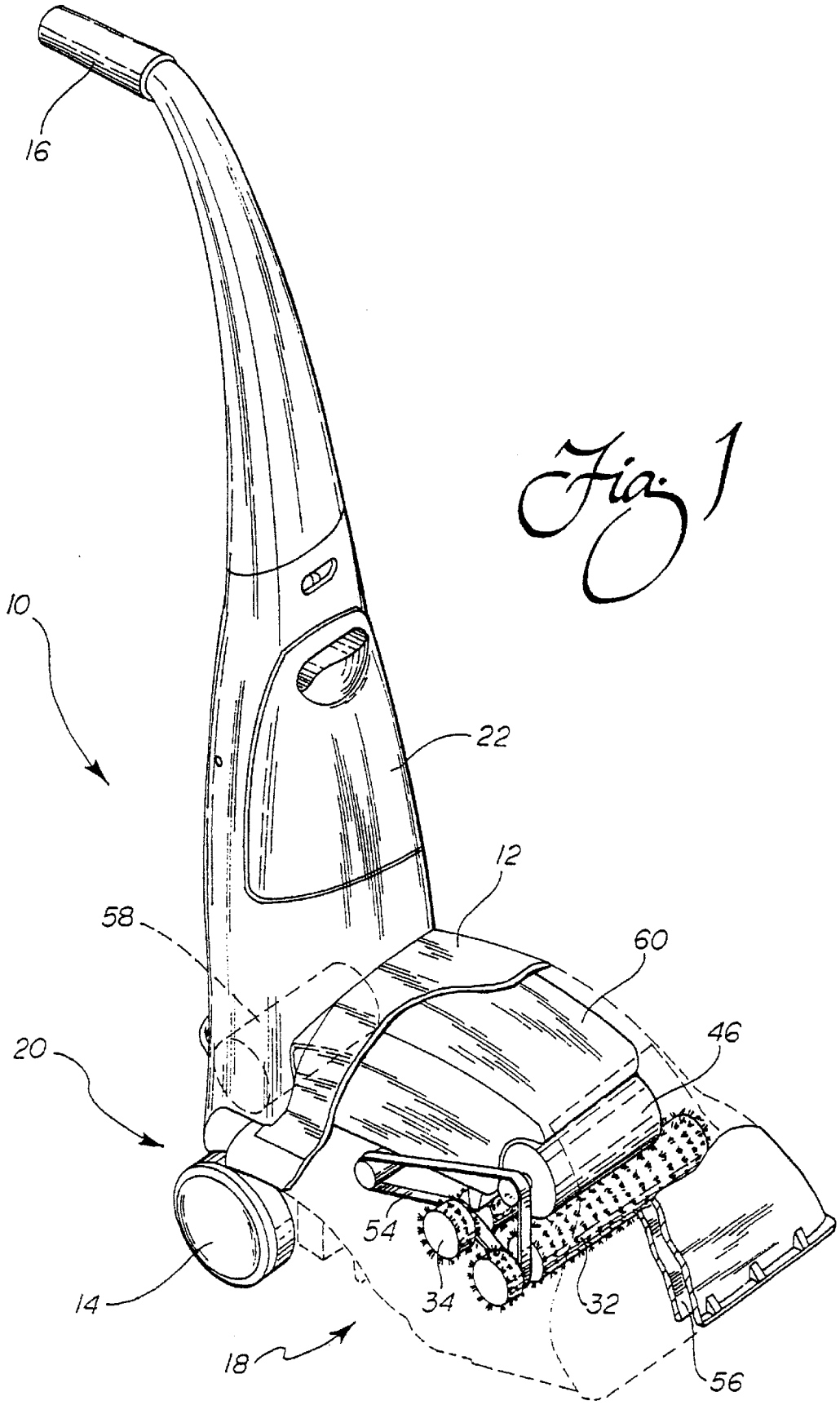
FIG. 1 is a perspective view of an extractor constructed in accordance with the teachings of the present invention.

Reference is now made to FIG. 1 generally showing an extractor 10 constructed in accordance with the teachings of the present invention for cleaning carpet or a like surface appropriate for cleaning by means of liquid extraction. As shown, the extractor 10 generally includes a housing 12 supported for movement relative to the carpet to be cleaned by means of a pair of wheels 14 (only one shown in the figure). A handle 16 is mounted by means of a hinge assembly (not shown) in a manner known in the art. The handle 16 allows for the manipulating and controlling of the extractor 10.

Figure 2:
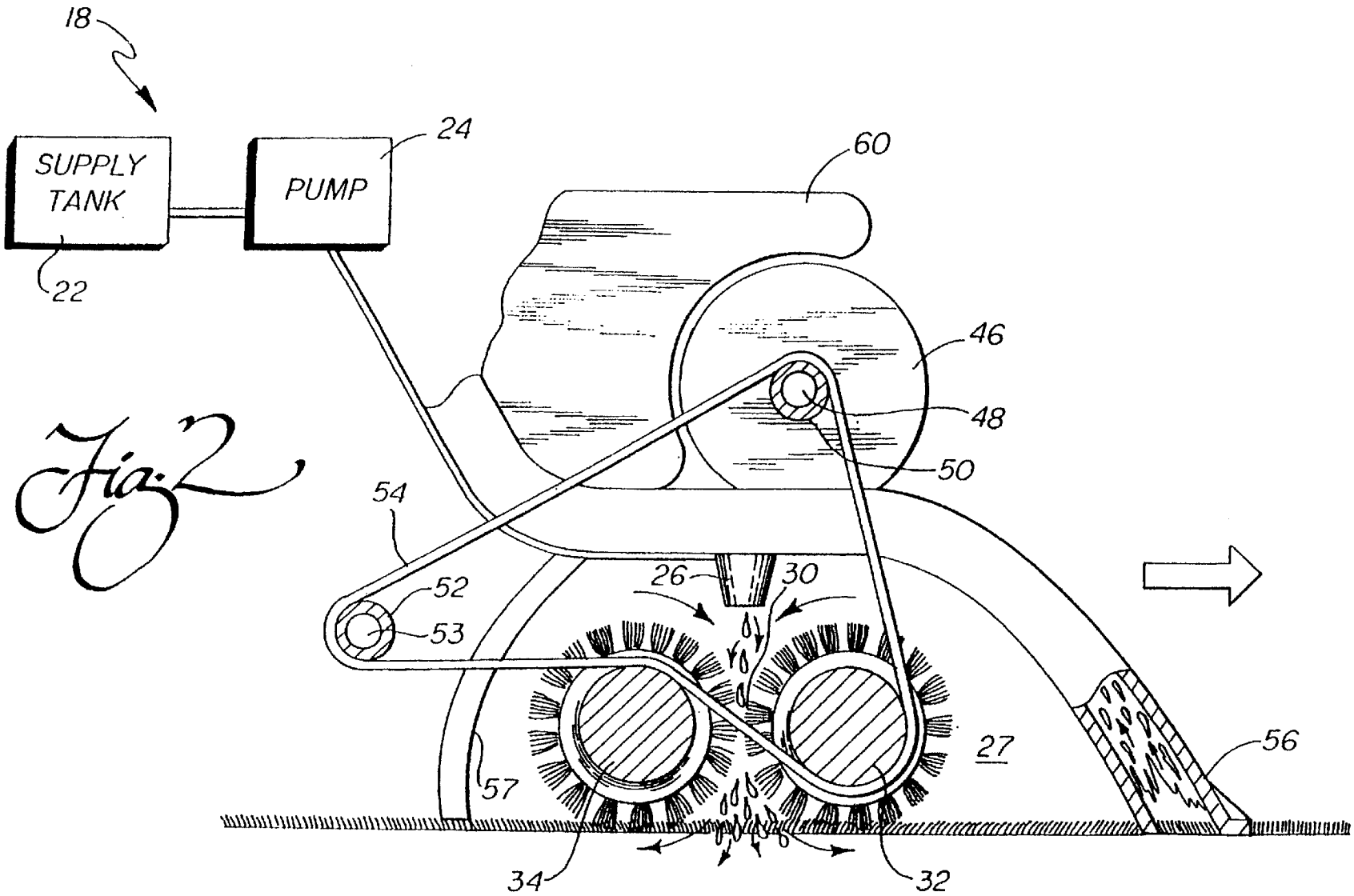
FIG. 2 is a partially schematical and cross-sectional side elevational view showing the relative arrangement of the components of the cleaning liquid delivery system and cleaning liquid recovery system including particularly the agitators, manifold and recovery nozzle.
Figure 3:
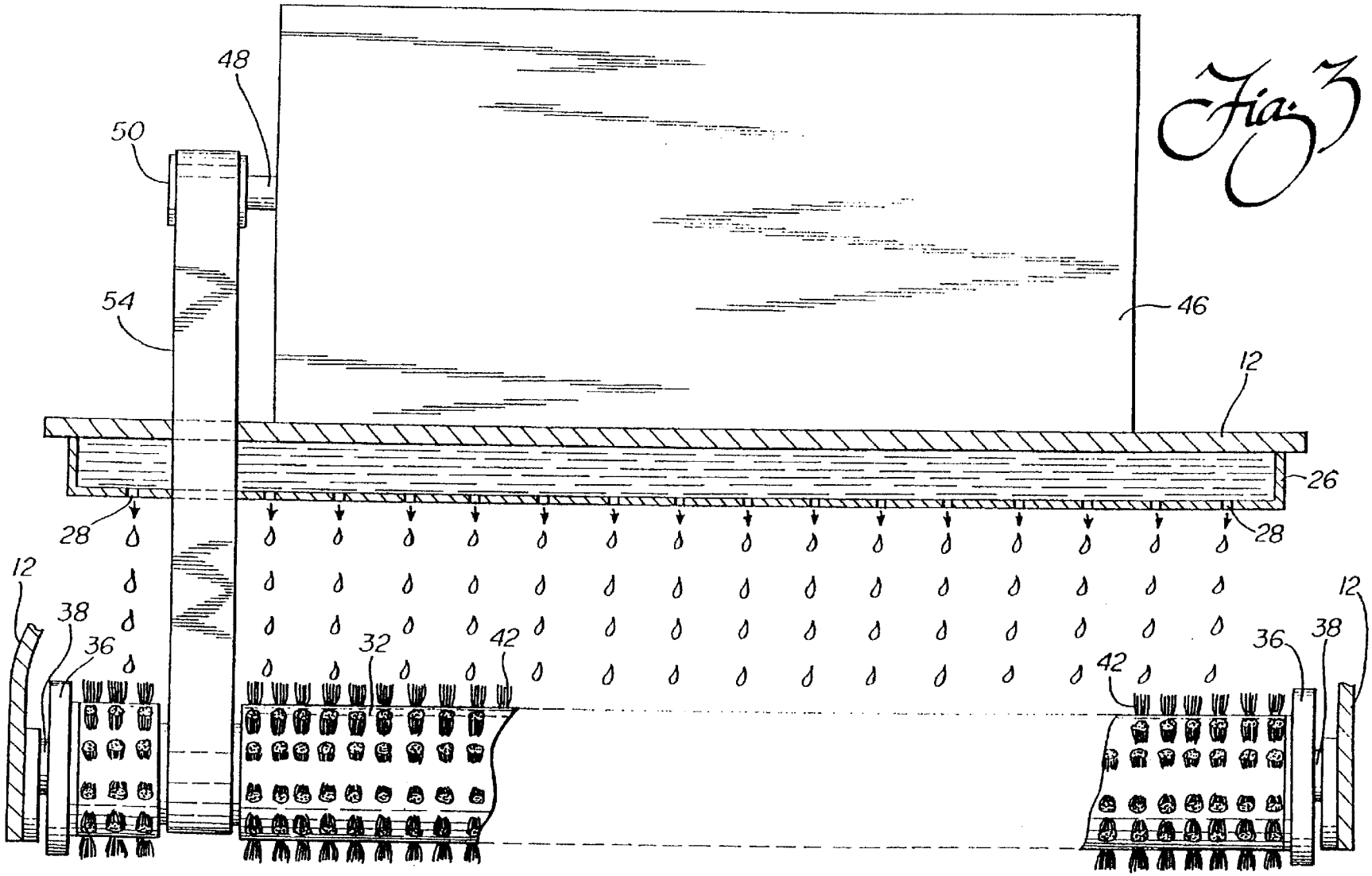
FIG. 3 is a partially schematical and cross-sectional front elevational view of the same structure as shown in FIG. 2.

The housing 12 carries a cleaning liquid delivery system, generally designated by reference numeral 18, and a cleaning liquid recovery system generally designated by reference numeral 20. More specifically as also shown in FIG. 2, the cleaning liquid delivery system 18 includes a cleaning liquid supply tank 22 that may, for example, be mounted in the handle 16. Hot water, a mild detergent solution or any other cleaning composition known in the art to be appropriate for liquid extraction cleaning may be utilized. Preferably, a pump 24 pumps cleaning liquid from the supply tank 22 to a manifold 26 (see also FIG. 3) positioned near the center of the agitator chamber 27 defined by the housing 12. The pump 24 may include its own electric drive motor or be driven by means of the agitator motor 46 or the motor of the vacuum fan and motor assembly 58 described below. Alternatively, a 30 simple gravity flow feed line could be utilized instead of the pump.

The manifold 26 includes a longitudinal axis that extends across substantially the entire transverse dimension of the extractor 10. A series of delivery ports 28 are provided at spaced locations along the length of the manifold. These delivery ports 28 may be the same or different sizes and may be provided at the same or different spacings as necessary to provide substantially even distribution of cleaning liquid across the width of the extractor. The delivery ports 28, of course, have a diameter sufficiently large to provide the desired quantity of cleaning liquid when the pump 24 is in operation.

In operation, the ports 28 deliver cleaning liquid at spaced locations across the transverse dimension of the nip 30 provided between the first and second agitators 32, 34. These agitators 32, 34 are mounted for relative rotation with respect to the housing 12 so as to be just touching, slightly overlapping or slightly separated. This mounting may be completed in any manner well known to those skilled in the art. For example, each agitator 32, 34 may rotate on a shaft (not shown) bridging between and supported by bearings held by a pair of end caps 36. Each end cap 36 carries a lug 38 that is received in a mating slot in the housing 12.

Preferably, the first and second agitators 32, 34 are bristle brushes. Any style of bristle pattern may be utilized and the bristles 42 themselves may be directly tufted or inserted into each agitator or even carried by means of a replaceable strip attached to the body of each agitator. In the alternative, a resilient wiper blade may be used as a substitute for the bristles. Of course, other alternative agitator designs may be utilized including, for example, a series of resilient projecting elastomeric fingers.

The agitators 32, 34 are driven by means of a drive assembly generally designated by reference numeral 44. Drive assembly 44 comprises a drive motor 46 mounted to the housing 12. The drive motor 46 includes a drive shaft 48 connected to a drive pulley 50. Drive pulley 50 is connected to an idler pulley 52 carried for relative rotation as stub shaft 53 fixed to the housing 12 and the first and second agitators 32, 34 by means of a drive belt 54. Drive belt 54 is preferably a double sided belt although a single cog belt or flat belt could be utilized. As shown, drive belt 54 extends around the idler pulley 52 over the top of the second agitator 34 and around the bottom of the first agitator 32 before returning to the drive pulley 50. Thus, as the motor 46 is driven in the clockwise direction shown in drawing FIG. 2, it should be appreciated that the first and second agitators 32, 34 are driven in counterrotating directions as shown: that is, the relative rotation of the agitators 32, 34 in the nip 30 is generally away from the manifold 26 or housing 12 and toward the carpet to be cleaned (note action arrows A).

The cleaning liquid recovery system 20 includes a recovery nozzle 56 carried at the front of the housing 12 aligned with and immediately adjacent to the first agitator 32. It should be noted that the first agitator 32 is rotated in a direction toward the recovery nozzle 56 and this aids in the efficient recovery and extraction of cleaning liquid and entrained dirt and soil associated therewith from the carpet being cleaned.

The nozzle 56 is, of course, in communication with a vacuum generator such as a fan and motor assembly 58 carried in the housing. More specifically, cleaning liquid and entrained soil and dirt are extracted from the carpet being cleaned and drawn through the nozzle 56 by the fan and motor assembly 58 to a dirty liquid recovery tank 60. This recovery tank 60 is equipped with any of a number of filtering systems of a type well known in the art for separating the air from the cleaning liquid whereby the cleaning liquid is trapped and maintained in the recovery tank 60 and the air is exhausted into the environment.

The method of operation of the extractor 10 will now be described in detail. Cleaning liquid from the supply tank 22 is delivered by gravity flow or the pump 24 shown to the manifold 26. The cleaning liquid is then distributed by the ports 28 in the manifold 26 so that it drops into the nip 30 between the first and second agitators 32, 34 in substantially even distribution along the entire width of the extractor 10. The counterrotating action of the agitators 32, 34 as shown by action arrows A in FIG. 2 effectively parts the carpet nap to its base and causes the cleaning liquid to be propelled deep into the carpet being cleaned.

As the extractor 10 is manipulated back and forth by the operator through the handle 16, the counterrotating agitators 32, 34 serve to scrub both sides of the nap of the carpet, flexing the carpet fibers back and forth, to provide good and thorough cleaning action. Simultaneously, the suction generated by the fan and motor assembly 58 is closely coupled to the carpet by the nozzle 56. In this way air is drawn through the carpet nap. The nozzle 56 is positioned in front of and adjacent to the first agitator 32. The lowermost surface of the agitator 32 in contact with the carpet nap rotates in the direction of action arrow A towards the nozzle 56. Thus, cleaning liquid with entrained dirt and soil are swept toward the nozzle 56 and efficient and effective recovery of the cleaning liquid and entrained dirt and soil is thereby insured. The cleaning liquid and entrained dirt and soil are then captured in the recovery tank 60 before the air is exhausted back into the environment. Conversely, cleaning liquid swept rearwardly by the second agitator 34 engages the shield 57 defining the agitator chamber 27. This shield 57 functions to direct the cleaning liquid back toward the nip 30 where it is recycled and again used to clean the carpet.

In summary, numerous benefits result from employing the concepts of the present invention. The orientation of the clean liquid distribution manifold 26, agitators 32, 34 and nozzle 56 in conjunction with the counterrotating direction of the agitators insures an efficient deep cleaning action heretofore unavailable in the art. This is a particularly beneficial system on an extractor that feeds cleaning liquid by gravity rather than high pressure pump since the agitators function to propel the cleaning liquid downwardly into the carpet nap. The described benefits are all achieved in a relatively simple and inexpensive structure that provides reliable operation over an extended service life. Further, it should be appreciated that the "push" of one of the counterrotating agitators 32 effectively offsets the "pull" of the other counterrotating agitator 34, thereby making the extractor 10 easier to guide and control through manipulation of the handle 16.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

In the claims:

1. An extractor for cleaning carpet comprising:

a housing supported for movement relative to said carpet to be cleaned;

a handle for manipulating and controlling said extractor;

a cleaning liquid delivery system carried by said housing, said cleaning liquid delivery system including a cleaning liquid supply tank and first and second aligned agitators; and a cleaning liquid recovery system carried by said housing, said cleaning liquid recovery system including a recovery nozzle, a vacuum generator and a dirty cleaning liquid recovery tank;

said extractor being characterized by;

a manifold for receiving said cleaning liquid from said supply tank and directing said cleaning liquid into a nip defined between said first and second agitators; and a drive assembly for counterrotating said first and second agitators so that relative rotation of said first and second agitators in said nip is generally away from said manifold and toward said carpet to be cleaned whereby said cleaning fluid is propelled deep into said carpet to provide enhanced penetration and cleaning effect.

2. The extractor of claim 1, wherein said recovery nozzle is aligned with and adjacent to said first agitator, said first agitator being rotated in a direction toward said recovery nozzle.

3. The extractor of claim 1, wherein said manifold includes a longitudinal axis aligned with and parallel to longitudinal axis of said first and second agitators and a series of delivery ports provided in and spaced along said manifold opposite said nip.

4. An extractor for cleaning carpet comprising:

a housing supported for movement relative to said carpet to be cleaned;

a handle for manipulating and controlling said extractor;

a cleaning liquid delivery system carried by said housing, said cleaning liquid delivery system including a cleaning liquid supply tank and first and second aligned agitators defining a nip therebetween; and a cleaning liquid recovery system carried by said housing, said cleaning liquid recovery system including a recovery nozzle, a vacuum generator and a dirty cleaning liquid recovery tank;

said extractor being characterized by;

a drive assembly for counterrotating said first and second agitators so that relative rotation of said first and second agitators in said nip is generally away from said housing and toward said carpet to be cleaned whereby said cleaning fluid is propelled deep into said carpet to provide enhanced penetration and cleaning effect.

5. A method of cleaning carpet by cleaning liquid extraction, comprising:

delivering cleaning liquid into a nip defined between a pair of counterrotating agitators;

propelling said cleaning liquid with said pair of counterrotating agitators through said nip deep into said carpet to be cleaned; and recovering said cleaning liquid.

* * * * *